United States Patent [19]

Engel

[11] 4,292,570

[45] * Sep. 29, 1981

[54] ENERGY-CONSERVING ILLUMINATION SYSTEM

[75] Inventor: Joseph C. Engel, Monroeville, Pa.

[73] Assignee: Westinghouse Electric Corp., Pittsburgh, Pa.

[ * ] Notice: The portion of the term of this patent subsequent to Apr. 3, 1996, has been disclaimed.

[21] Appl. No.: 24,766

[22] Filed: Mar. 28, 1979

Related U.S. Application Data

[63] Continuation-in-part of Ser. No. 861,591, Dec. 12, 1977, Pat. No. 4,147,962.

[51] Int. Cl.[3] ..... H05B 41/38

[52] U.S. Cl. ..... 315/360; 307/141; 315/156; 315/159; 315/307

[58] Field of Search ..... 315/156, 158, 159, 194, 315/199, 291, 307, 360; 307/141

[56] References Cited

U.S. PATENT DOCUMENTS 2,295,894 9/1942 Dewan ..... 315/360 X
3,989,976 11/1976 Tabor ..... 315/291
4,008,415 2/1977 De Avila-Serafin et al. ... 315/159 X
4,147,962 4/1979 Engel ..... 315/291
4,209,728 6/1980 Membreno ..... 315/159

FOREIGN PATENT DOCUMENTS 1538481 1/1979 United Kingdom ..... 250/214 AL

*Primary Examiner*—Eugene R. La Roche
*Attorney, Agent, or Firm*—R. S. Lombard

[57] ABSTRACT

An energy-conserving solid-state-controlled illumination system which operates high-intensity-discharge lamps. The system operates the lamps at about a predetermined rated power consumption with a relatively high light output for a predetermined initial period of time during the initial night when a high degree of illumination is most needed. The system then operates the lamps for a later period of the night at a reduced power for a second predetermined period of time when a lower degree of illumination can be tolerated. Then if the lamps are still energized according to seasonal variations, the system thereafter operates the lamps at the relatively high light output for the remainder of the night to accommodate early morning traffic.

6 Claims, 4 Drawing Figures

ENERGY-CONSERVING ILLUMINATION SYSTEM

CROSS-REFERENCE TO RELATED APPLICATIONS

This is a continuation-in-part of copending application, Ser. No. 861,591 filed Dec. 12, 1977, and now U.S. Pat. No. 4,147,962, dated Apr. 3, 1979, and owned by the same assignee, which discloses an energy-conserving solid-state-controlled illumination system for operating high-intensity-discharge lamps at about a pre determined rated power consumption with a relatively high light output for a predetermined time when a high degree of illumination is desirable and thereafter operating the lamps at about a predetermined power less than rated power consumption when a lower degree of illumination can be tolerated.

In copending application, Ser. No. 861,587, filed Dec. 19, 1977 by Robert T. Elms and now U.S. Pat. No. 4,147,961, dated Apr. 3, 1979, is disclosed a lighting system which operates lamps with a relatively high light output for a predetermined proportion of the night when a high degree of illumination is desirable and then operates the lamps with a lower light output when a lower degree of illumination can be tolerated. In addition, the system automatically compensates for seasonal variations in the length of night.

In copending application, Ser. No. 920,291, filed June 29, 1978, and now U.S. Pat. No. 4,162,428, dated July 24, 1979, by Robert T. Elms, and owned by the present assignee, is disclosed a variable inductance ballast apparatus for an HID lamp which comprises a laminated E-I core having non-magnetic gaps intermediate the E-conformed and I-conformed members. A main winding is carried on the leg of the E-conformed member to provide two closed magnetic paths, and a control winding is wrapped about another of the legs and encircles only one of the magnetic paths. When the control winding is closed, the resulting counter MMF decreases the inductance of the ballast apparatus by a predetermined amount. Such a variable inductance ballast is particularly adapted for use with a circuit as described herein.

In copending application, Ser. No. 920,581, filed June 29, 1978, and now U.S. Pat. No. 4,162,429, dated July 24, 1979, by the present applicant and Robert T. Elms, and owned by the present assignee, is disclosed a circuit for sensing both lamp voltage and line voltage and to develop therefrom a composite control signal for actuating a bilateral switch to vary the inductance of a ballast apparatus. The sensing circuit is particularly designed to develop a control signal which can be varied over a very wide range of the phase of each half cycle of an alternating current potential so that only a relatively small change of inductance in the ballast apparatus is needed to achieve the proper degree of lamp power control.

BACKGROUND OF THE INVENTION

This invention relates to control systems for vapor-discharge lamps and, more particularly, to a control system which automatically dims the lamps after a predetermined time when a lower degree of illumination can be tolerated, and then, automatically brightens the lamps for the remainder of the night to accommodate early morning traffic.

In recent years much effort has been directed toward developing lighting systems that are energy-conserving.

Present day outdoor lighting systems, such as those used for street lighting and parking areas waste energy because these systems were not designed to operate at more than one power consumption level. There have been attempts to conserve energy with these present systems such as, turning a portion of the lights in a system completely off. This approach though conserving energy may be a safety hazard because of the poor lighting distribution that may result. The aforesaid copending application Ser. No. 861,591 is an improvement over such approach because it provides for automatic dimming of an entire lighting system with uniform light distribution. The aforesaid copending application Ser. No. 861,587 is a further improvement because, as already stated, it automatically compensates for the seasonal variations in the length of night. The present invention automatically provides for a higher degree of illumination for early morning traffic during that period of the year when the "rush hour" begins while it is still dark.

SUMMARY OF THE INVENTION

This invention provides an energy-conserving solid-state controlled illumination system which operates high-intensity-discharge lamps at about predetermined rated power with a relatively high light output for a predetermined initial period of time during the initial night when a higher degree of illumination is most needed. The system then operates the lamps for a later period of the night at a reduced power which is a predetermined amount less than rated power consumption for a second predetermined period of time when a lower degree of illumination can be tolerated. Then, if the lamps are still energized according to seasonal variations, thereafter the lamps are operated at the relatively high light output for the remainder of the night to accommodate early morning traffic.

The system comprises input terminal means adapted to be connected to a source of electrical energy and output terminal means adapted to be connected to the input terminals of the lamp means. Lamp ballasting means is provided in circuit with the lamp means between the input terminal means and the output terminal means. The lamp ballasting means has a first operating mode in which the average power passed to the lamp means causes same to operate at about rated power consumption. The lamp ballasting means also has a second operating mode in which the average power passed to the lamp means is a predetermined amount less than the rated power consumption for the lamp means.

The system also comprises main switching means having an open state and a closed state. The main switching means is connected in circuit with the input terminal means and the lamp ballasting means to energize the lamp means when the switching means is in the closed state and to deenergize the lamp means when in the open state. Controlled switching means is also provided, the controlled closing and opening of which determines whether the ballasting means is in the first operating mode or in the second operating mode.

The system further comprises timing means actuated by closing of the main switching means. The timing means when actuated, operates to generate a first time-related control signal after the initial predetermined period of time has elapsed, thereafter, the timing means continues to operate to count down doward the second predetermined period of time, and if the timing means is still actuated by the main switching means remaining closed after the second predetermined period of time has elapsed, the timing means operates to generate a second time-released control signal. the first time-related control signal from the timing means is applied to said controlled switching means to switch the ballasting means from the first operating mode to the second operating mode. In the case the main switching means is still closed after the second predetermined period of time has elapsed, the second time-related control signal from the timing means is applied to the controlled switching means to switch the ballasting means from the second operating mode back to the first operating mode. The system, thereafter, continues operation until the main switching means is opened, and the system is thereafter quiescent until the main switching means is again closed.

The timing means preferably comprises oscillator means for generating timed pulses after the closing of the main switching means and digital counter means for counting a first predetermined number of pulses generated by the oscillator corresponding to the predetermined initial period of time and initiating the first time-related control signal after the first predetermined number of pulses have been counted. The timing means then counts toward a second predetermined number of pulses generated by the oscillator means, corresponding to the second predetermined period of time, and initiates the second time-related control signal after the second predetermined number of pulses are counted if the timing means is still energized.

The controlled switching means typically comprises a solid-state gate-controlled switching means and gate control means responsive to the first and second time-related control signals generated by the timing means. The gate control means has an output connected to the gate of the gate-controlled switching means to control the mode of the ballasting means.

The digital counter means preferably has a reset state corresponding to a number at which the count begins. The reset state is typically controlled by a control means to cause the digital counter means to reset upon predetermined conditions occurring.

BRIEF DESCRIPTION OF THE DRAWINGS

The invention can best be understood by reference to the following drawings, in which.

DESCRIPTION OF THE PREFERRED EMBODIMENTS

Figure 1:
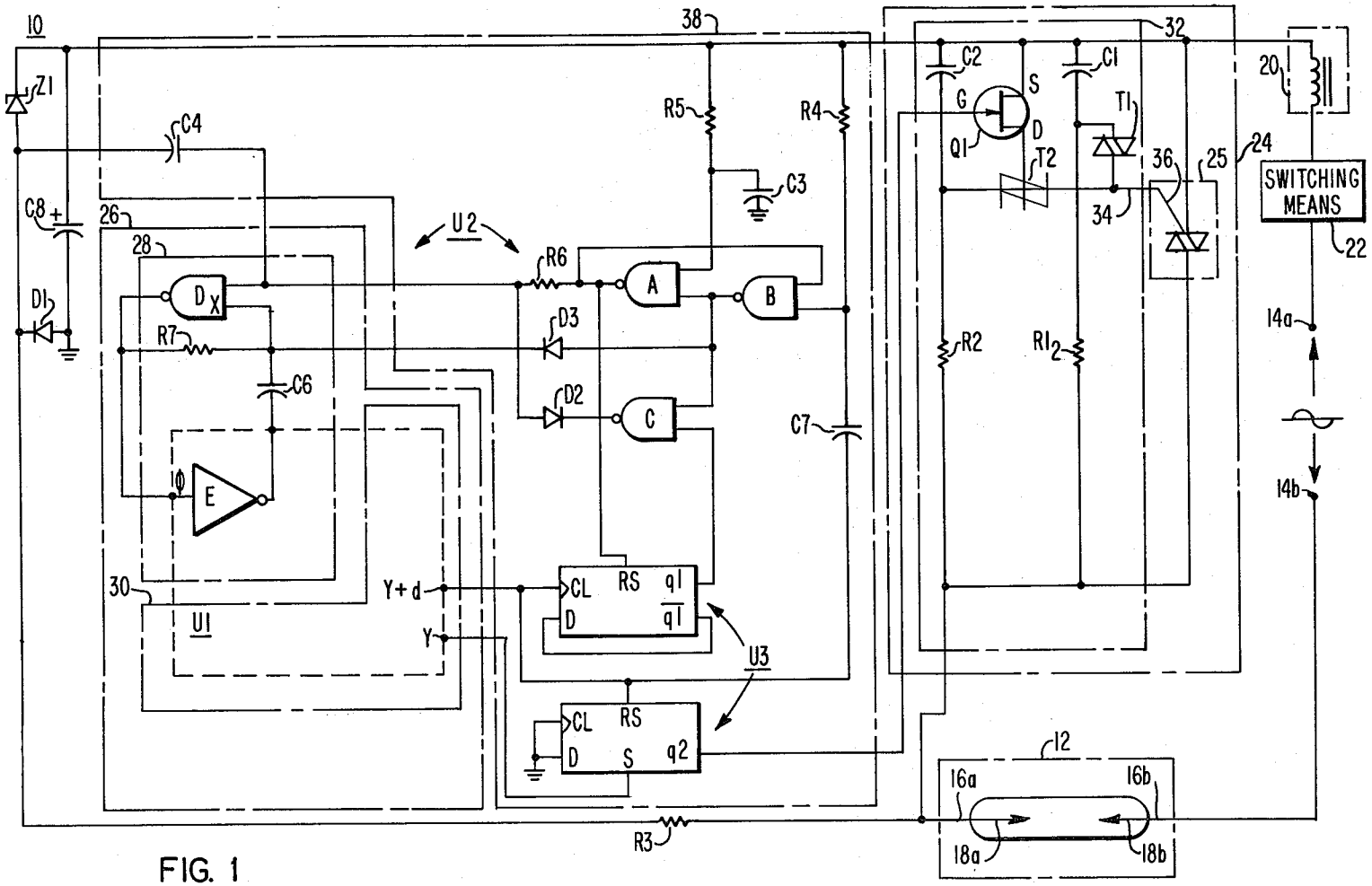
FIG. 1 is a schematic diagram of a preferred circuit configuration of the invention with a lag-type ballast.

In FIG. 1 is shown an energy-conserving solid-state-controlled illumination system 10 which operates high-intensity-discharge lamp means 12 at about a predetermined rated power consumption with a relatively high light output for a predetermined initial period of time during the initial night when a high degree of illumination is most needed and then operates the lamp means 12 for a later period of the night at a reduced power which is a predetermined amount less than rated power consumption for a second predetermined period of time when a lower degree of illumination can be tolerated, and thereafter, if the lamp means 12 is still energized according to the seasonal variations, operates the lamp means at the relatively high light output for the remainder of the night to accommodate early morning traffic. The system comprises input terminal means 14*a*, 14*b* adapted to be connected to a source of electrical energy and output terminal means 16*a*, 16*b* adapted to be connected to input terminals 18*a*, 18*b* of the lamp means 12.

The system also comprises lamp ballasting means 20 which are shown in FIG. 1 as a lag-type ballast. Lamp ballasting means 20 is in circuit with the lamp means 12. The lamp ballasting means 20 has a first operating mode (or bright mode) in which the average power passed to the lamp means 12 causes same to operate at about rated power consumption. The lamp ballasting means 20 also has a second operating mode (or dimmed mode) in which the average power passed to the lamp means 12 is a predetermined amount less than the rated power consumption for the lamp means 12.

The system 10 further comprises main switching means 22 having an open state and a closed state. The main switching means 22 may be a photocontrol switch, for example, or a manual, centrally located switch controlling a bank of lamps. The main switching means 22 is connected in circuit with the input terminal means 14*a*, 14*b* and the lamp ballasting means 20 to energize the lamp 12 when the switching means 22 is in the closed state and to deenergize the lamp 12 when in the open state. Controlled switching means 24 is provided, the controlled closing and opening of which determines whether the ballasting means 20 is in the first operating mode or the second operating mode.

The system 10 also further comprises timing means 26 actuated by closing the main switching means 22. The timing means when actuated, operates to generate a first time-related control signal after the initial predetermined period of time has elapsed, thereafter, the timing means 26 continues to operate to count down toward the second predetermined period of time, and if the timing means 26 is still actuated by the main switching means 22 remaining closed after the second predetermined period of time has elapsed, the timing means 26 operates to generate a second time-related control signal. The first time-related control signal is applied to the controlled switching means 24 to switch the ballasting means 20 from the first operating mode to the second operating mode. In the case of main switching means 22 is still closed after the second predetermined period of time has elapsed, the second time-related control signal is applied to the controlled switching means 24 to switch the ballasting means 20 from the second operating mode back to the first operating mode. The system continues operation until the main switching means 22 is opened typically with the onset of sufficient daylight, and the system 10 is thereafter quiescent until the main switching means 22 is again closed.

The timing means 26 preferably comprises oscillator means 28 for generating timid pulses after closing of the main switching means 22 and digital counter means 30 for counting a first predetermined number of pulses generated by the oscillator means 28 corresponding to the predetermined initial period of time and initiating the first time-related control signal after the first predetermined number of pulses are counted and for counting toward a second predetermined number of pulses generated by the oscillator means corresponding to the second predetermined period of time and initiating the second time-related control signal if the timing means 26 is still energized. Controlled switching means 24 preferably comprises a solid-state gate-controlled switching means 25, and gate control means 32 responsive to the first and second time-related control signals generated by the timing means 26. The gate control means 32 has an output 34 connected to the gate 36 of the gate-controlled switching means 25 to control the mode of the ballasting means 20.

The illumination system 10 functions as follows: after the main switching means 22 switches to the closed state and digital counter 30 counts the first predetermined number of pulses from the oscillator 28, the digital counter 30 initiates the first time-related control signal. The gate control 32 responds to the first time-related control signal to place the ballasting means 20 in the second operating mode. In the case the main switching means 22 is still closed after the second predetermined period of time has elapsed, which is equivalent to the digital counter 30 counting the second predetermined number of pulses, the digital counter 30 initiates the second time-related control signal. The gate control 32 responds to the second time-related control signal to place the ballasting means in the first operating mode until the main switching means 22 is opened typically with the onset of daylight. System 10 is thereafter quiescent until the main switching means 22 is again switched to the closed state to initiate counting of the timed pulses by the digital counter 30.

The digital counter 30 of system 10 preferably has a reset state corresponding to a number at which the count begins and the generated time pulses of the oscillator means 28 has a high frequency mode for resetting the digital counter 30, and a low frequency mode to cause the digital counter 30 to initiate the first and second time-related control signals after the first and second predetermined number of timed pulses have respectively been counted.

The system 10 also desirably includes control means 38 which, upon initial energization of the system, starts the high-frequency mode of the oscillator means 28 which is continued until the digital counter 30 is reset. The high-frequency mode of the oscillator means 28 is then stopped and the low-frequency mode of the oscillator means 28 is initiated which causes the ballast 20 to operate in the first operating mode. Thus the ballast 20 operates in the first (or bright) mode until the first time-related control signal is generated by the digital counter 30 and the ballast 20 is then placed in the second operating (or dimmed) mode. In the case the main switch 22 is still closed after the second predetermined period of time has elapsed, upon the second time-related control signal being generated, the ballast 20 is returned to the first operating (or bright) mode which continues until the system 10 is deenergized by the main switch 22.

Figure 3:
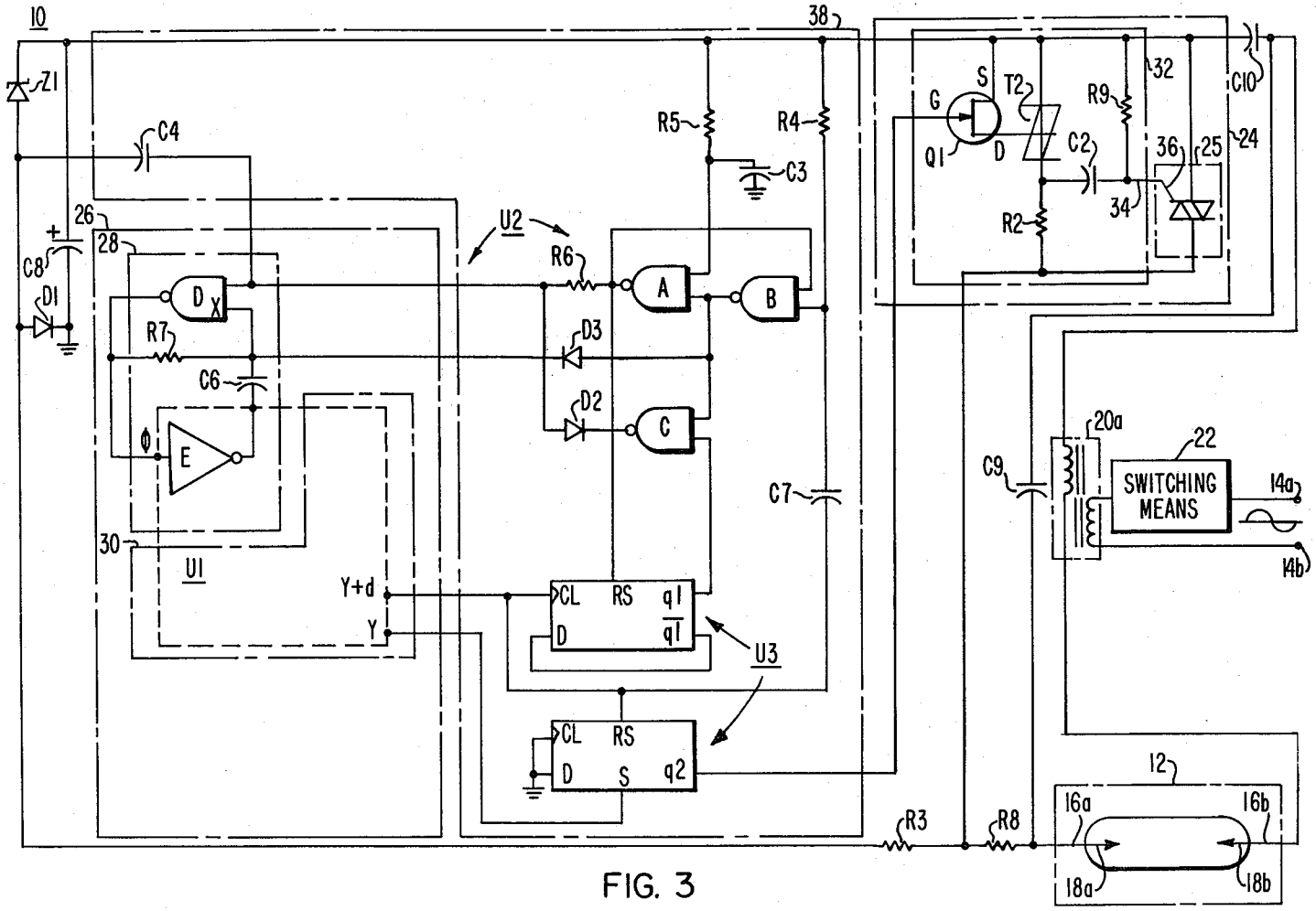
FIG. 3 is a schematic diagram showing a preferred circuit configuration of the invention with a regulated output ballast; and, FIG. 4 is a schematic diagram of a preferred circuit configuration with a variable inductance ballast.

The following table of components specifies typical values for use in the circuits shown in FIGS. 1 and 3.

TABLE

| Component | Value |
|---|---|
| 12 | 400 W Hg |
| 20 | 240 VAC, 400 W Hg, lag ballast |
| 22 | Photocontrol |
| 24,25 | 6A, 500 VAC switch, Electronic Control Corporation Part No. Q5006 I |
| Q1 | 2N4222 N channel, junction fet |

TABLE -continued

| Component | Value |
|---|---|
| T1 | 40 V trigger diode (DIAC), ECC |
| T2 | MBS 4991, Motorola gated trigger |
| U1 | CD 4045 AD, RCA COS/MOS 21-stage counter, plastic, includes inverter labeled E |
| U2 | CD 4011AD, RCA COS/MOS Quad 2 Input NAND Gates, plastic, labeled A,B, C,D |
| U3 | CD 4013AD, RCA COS/MOS Dual "D Flip-Flop" |
| C1 | .047 μf, 100V |
| C2 | .047 μf, 100V |
| C3 | .1 μf, 100V |
| C4 | .0047 μf, 100V |
| C5 | .001 μf, 100V |
| C6 | 100 μ μf, 100V |
| C7 | .001 μf, 100V |
| C8 | 15 μf, 15V, epoxy-dipped tantalum |
| C9 | 12 μf, 240 VAC |
| C10 | 12 μf, 240 VAC |
| D1 | 1N457 20 ma, 60V |
| D2 | 1N457 20 ma, 60V |
| D3 | 1N457 20 ma, 60V |
| Z1 | 8.2V, 10%, .4W zener diode 1N959 |
| R1 | 100K, 5%, ½W carbon |
| R2 | selected, ½W carbon |
| R3 | 27 K, 5% 1W |
| R4 | 470K, 5%, ¼W carbon |
| R5 | 470K, ¼W carbon |
| R6 | 100K, ¼W carbon |
| R7 | 1M, ¼W carbon |
| R8 | 1μ, 5W |
| R9 | 1K, 5%, ¼W, carbon |

Figure 2:
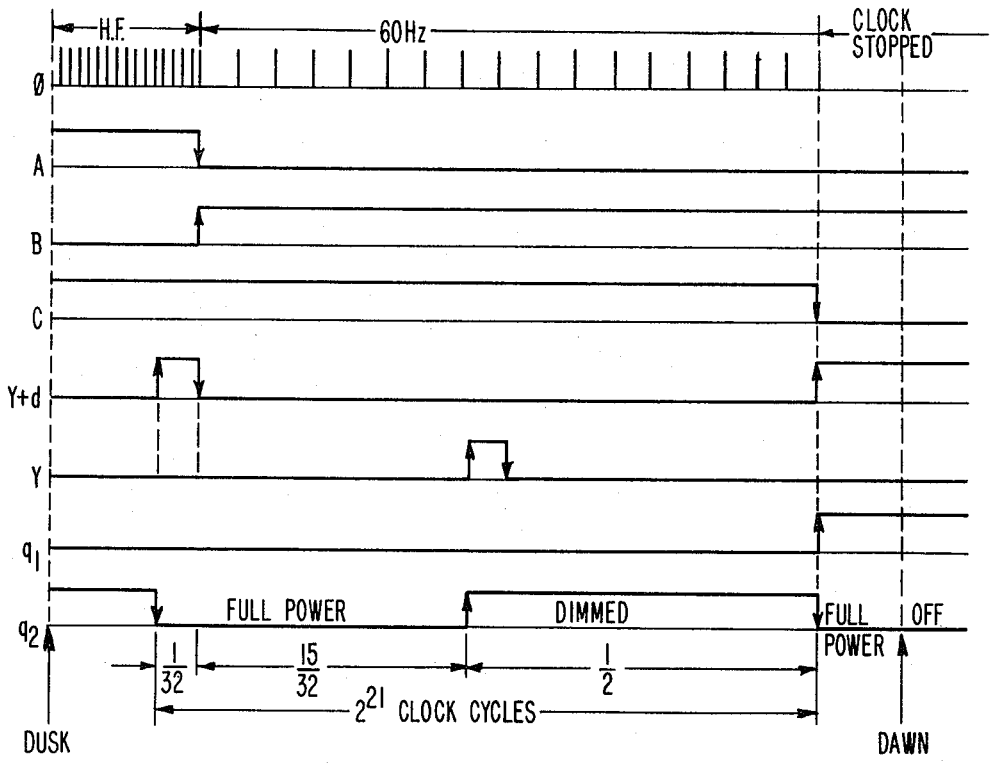
FIG. 2 is a chart of the timing sequence showing the "logic condition" of various component outputs during operation of the illumination system.

Referring to FIGS. 1 and 2 the operation of the circuit is as follows:

For a lag-type ballast the solid-state gate-controlled switch 25 is in series with the lamp 12 and the lag ballast 20. For the lag ballast 20 to be in the second operating mode or the dimmed mode, the gate-controlled switch 25 must conduct a predetermined percentage of each half cycle less than when in the first operating mode. The electronic portion of the circuit shown in FIG. 1 is powered by the voltage that appears across gate-controlled switch 25, so that switch 25 is never permitted to be on 180° out of every half cycle. There is always a small 10° or 20° period in the beginning of each half cycle when gate-controlled switch 25 is off even when the ballasting means 20 is in the first operating mode. This causes the switch 25 to support a 100-volt pulse each half cycle. This pulse via R3, D1, and C8 becomes the power supply for the electronic circuit. The value of the supply voltage is determined by zener diode Z1 which is set at about 10 volts, for example. This condition exists when the voltage on R3 is negative and the voltage on the positive terminal of C8 is positive. In the next half cycle when the line voltage reverses, the current flows through R3 into the anode of Z1 out the cathode of Z1 to the other side of the power line, which results in D1 being essentially non-conductive, and C8 powers the electronic circuit, in essence being a half wave power supply. In the first operating mode the lamp 12 being a 400 watt Hg lamp, for example, operates at about rated power. In the embodiment as described, when the ballasting means 20 is in the second operating mode, the 400 watt Hg lamp operates at about 250 watts.

The digital counter means 30 of the timing means 26 as shown in FIG. 1 is a 21-stage dividing circuit. It requires $2^{21}$ timed input pulses through the input labeled $\phi$ of the digital counter 30, which is equivalent to receiving 2,079,152 timed input pulses before an output pulse corresponding to the second time-related control signal is generated at the output terminal labeled Y+d of the digital counter 30. As shown in FIG. 1 there is also an additional output terminal labeled Y where the first time-related control signal is generated. The difference between the occurrence of the Y output pulse (the first time-related control signal), and the Y+d output pulse (the second time-related control signal) is a delay of one-half the total timed period. Thus, the digital counter 30 produces the first and second time-related control signals for the total timed period. The time between the first and second time-related control signals or output pulses is equal to the time it takes the digital counter to count $2^{20}$ input pulses and corresponds to the second predetermined time period.

The high frequency mode of the oscillator means 28 for resetting digital counter 30 is produced by C6, R7, NAND gate D and the inverter E. This forms an oscillator having a frequency of about 100 kHz. Whether or not the high frequency mode of the oscillator means 28 is running is controlled by the control means 38.

The control means 38 functions as follows:

Referring to FIG. 1 when the circuit is initially energized C8 charges, and C3 is uncharged. If the voltage on C3 is low, or in a logic state "0", the high frequency mode of the oscillator means 28 will be activated. The high frequency mode is activated when the one input to NAND gate A in circuit with C3 is "0" being the same as the voltage on C3 this produces a logic "1" at the output of A. A "1" at the output of NAND gate A resets the q1 output of U3 to a logic "0" and also a logic "1" at the output of A means that there is a logic "1" at the one input to NAND gate D in circuit with the output of A. Thus, the other input, labeled "x", of NAND gate D becomes the controlling terminal. If "x" is high, or a logic "1", the output of D will be low, or a logic "0". If "x" is "0", then the output of D will be "1". "x" is part of the high frequency mode of the oscillator means 28. By driving "x" to a logic "0" the high frequency mode of the oscillator means 28 is permitted to operate. It will continue to operate until the high frequency mode is inhibited via D3. Whenever the bottom side of C7 is pulled negative, which occurs somewhere in the timing cycle when the digital counter 30 has counted no more than $2^{20}$ timed pulses, the Y+d output of the digital counter 30 will go high to a logic "1" for a short period of time resetting output q2 of U3 to a logic "0" and then the Y+d output will go to a logic "0". When the Y+d output goes to "0" it pulls the bottom side of C7 down which pulls the one input to NAND gate B in circuit with C7 low or to a logic "0". A logic "0" at one of the inputs to NAND gate B causes a "1" at the output of NAND gate B. With the output of B high, positive current will flow through the anode of D3 and drive the junction of R7, C6, D3 high or to a logic "1" which drives the "x" input of the NAND gate D high and stops the high frequency mode of the oscillator means 28 as shown in FIG. 2. At this point the digital counter 30 is reset to the beginning number which in this embodiment is 0. The low frequency mode of the oscillator means 28 then takes over. The high frequency mode thus resets the digital counter 30, a necessity because COS/MOS device U1 has no reset pin available. The reset mode will last no more than 10 seconds, i.e. $2^{20}$ cycles at 100 KHz.

The generated timed pulses of the low frequency mode of the oscillator means 28 are produced by the 60-cycle AC supply. C4 connected to the tie point of Z1, D1 and R3 couples the 60-cycle supply into one of the inputs of NAND gate D. This point goes low or to a logic "0" once every cycle in the 60-cycle period. When this point goes low the output of the NAND gate D goes high or to a logic "1" causing the low frequency mode or 60-cycle mode to generate timed pulses to the terminal labeled $\phi$ of the digital counter 30. The low frequency mode of the oscillator means 28 will continue until the first time-related control signal is generated at the output terminal Y. This will occur as indicated in FIG. 2 after $15/32\times2^{21}$ timed pulses have been generated by the 60-cycle supply or about 4.55 hours corresponding to the initial predetermined time period. When the first time-related control signal is generated at Y, it is generated as a high or logic "1" this causes the Q2 output of U3 to switch to a logic "1" causing the switching means 24 to switch the ballast 20 from the first operating mode or bright mode to the second operating mode or dimmed mode. The ballast 20 will remain in the dimmed mode for 4.85 hours (the second predetermined time period) until the second time-related control signal is generated at the Y+d output terminal, assuming the main switch 22 is still closed.

With regard to the functioning of the switching means 24, when the output q2 of U3 is low or a logic "0", before the low frequency mode of the oscillator means 28 is stopped, the source of Q1 is tied to the B+ potential or 10 volt supply and the gate potential is sufficiently low to keep Q1 turned off. With Q1 turned off, trigger diode T2 has an open gate terminal such that diode T2 is permitted to trigger whenever the voltage across it reaches 8 volts. The voltage across T2 reaches 8 volts when the voltage across C2 reaches 8 volts. This assumes that there is a resistor inside the gate-to-cathode region of the gate-controlled switch 25 so that all the voltage across C2 appears across T2. C2 is charged each half cycle through R2 with a very slight time delay of less than 1 millisecond. With the gate-controlled switch 25 off, the line voltage appears across R2 and C2. C2 charges up until it reaches the 8-volt trigger potential of T2 at which time T2 turns on, C2 is discharged into the gate of the gate-controlled switch 25. Switch 25 is thereby turned on and current is caused to flow through the ballast 20 into the lamp 12. With the q2 output of U3 low or at a logic "0" the gate-controlled switch 25 will be on most of each half cycle with a slight off time at the beginning of each half cycle to power the electronic circuit as previously mentioned. In this state the lamp 12 is at full power. The lamp 12 will remain at full power until digital counter 30 initiates the first time-related control signal at the output terminal Y. As already stated, this causes the output q2 of U3 to go to a logic "1" so that the guide of Q1 is tied to the B+ supply so that there is no reverse bias on the source-to-gate junction of Q1. Q1 is normally an ON device so that the gate terminal of T2 is tied to the B+ supply, and this makes it impossible to trigger T2. However, in parallel with the R2, C2 circuit is another circuit formed by R1, C1 and trigger diode T1, so that when the trigger diode T2 ceases to function, the charging of C1 through R1 will eventually cause C1 to reach the trigger potential of T1 at which time T1 will fire causing the gate-controlled switch 25 to be turned on. By properly selecting the values for R1, C1 and T1 such as those listed previously, the switch 25 turns on at a time later in the cycle constituting the second operating mode of the controlled-switching means 24. The later in the cycle switch 25 is turned on, the lower will be the second operating mode or dim mode power setting for the ballast 20.

Gate-controlled switch 25 as used in this embodiment can conduct current in either the positive or negative direction, and it can be turned on with either positive or negative gate current, but it is most sensitive to being turned on with positive gate current when it has a positive anode voltage, and likewise it is most sensitive to being turned on with negative gate current when the anode voltage is negative. The circuit as shown of the gate control means 32 is designed to achieve this result. In the case the main switch 22 is still closed after the second predetermined period of time has elapsed, upon the second time-related control signal being generated at a logic "1" at terminal Y+d of digital counter 30, output terminal q2 of U3 is caused to go low or to logic "0" thereby causing switching means 24 to switch the lamp 12 to pull power in the same manner as previously described. Also output terminal Q1 of U3 is clocked high to a logic "1" which resets the output of NAND gate C low or to a logic "0". A logic "0" at the output of NAND gate C stops the low frequency mode of the oscillator means 28 so that the ballast 20 will remain in the first operating mode or in the bright mode until the main switching means is disconnected which in the case of a photo control switch will occur at the onset of sufficient daylight.

The typical regulated output (R.O.) type ballast has a capacitor in series with the lamp. The power to the lamp can be controlled by changing the effective value of this capacitor. This is accomplished in the circuit shown in FIG. 3 by having two capacitors C9 and C10 in the circuit. C9 of the R.O. ballast **20*a* is in series with the lamp 12 and capacitor C10 in series with the solid-state gate-controlled switch 25 and R8 forms a parallel circuit with C9. When gate-controlled switch 25 is on, assuming R8 is a fairly small value, the total capacitor becomes C10 in parallel with C9. If switch 225 is off, the total capacitor is just C9 which is a smaller capacitor. Therefore, for the first operating mode of the ballasting means 20*a* the gate-controlled switch 25 is conducting. This occurs because the q2 output of U3 is low and Q1 is off so that the gate terminal of T2 is open and T2 is permitted to trigger whenever the voltage across it reaches 8 volts. The voltage across T2, as in the lag type ballast, reaches 8 volts when the voltage across C2 reaches 8 volts so that after a slight time delay the gate-controlled switch 25 conducts. Upon the second time-related control signal being generated at the Y output of digital counter 30, the q2 output of U3 goes high or to a logic "1" turning Q1 on and T2 is not permitted to trigger thereby maintaining the gate-controlled switch 25 off and removing C10 from the circuit. In this condition C9 alone is in series with lamp 12 and the ballast 20*a* is in the second operating mode or dim mode. In case the ballast 20*a* is still on after the second predetermined period of time has elapsed, the second time-related control signal is generated at the Y+d output of digital counter 30. The second time-related control signal is generated as a high or to a logic "1". This resets the q2 output of U3 low or to a logic "0" thereby causing the ballast 20*a* to return to the first operating mode or full power mode. Also, as in the case of the lag type ballast, the second time-related control signal also causes the Q1 output of U3 to go to a logic "1" which resets the output of NAND gate C to a logic "0". A logic "0" at the output of NAND gate C causes the low frequency mode of the oscillator means 28 to stop so that the ballast 20*a* will stay in the bright mode until the switch 22** is de-energized which in the case of a photo control switch will occur with the onset of sufficient daylight. This process will be restarted at dusk when power is reapplied.

Figure 4:
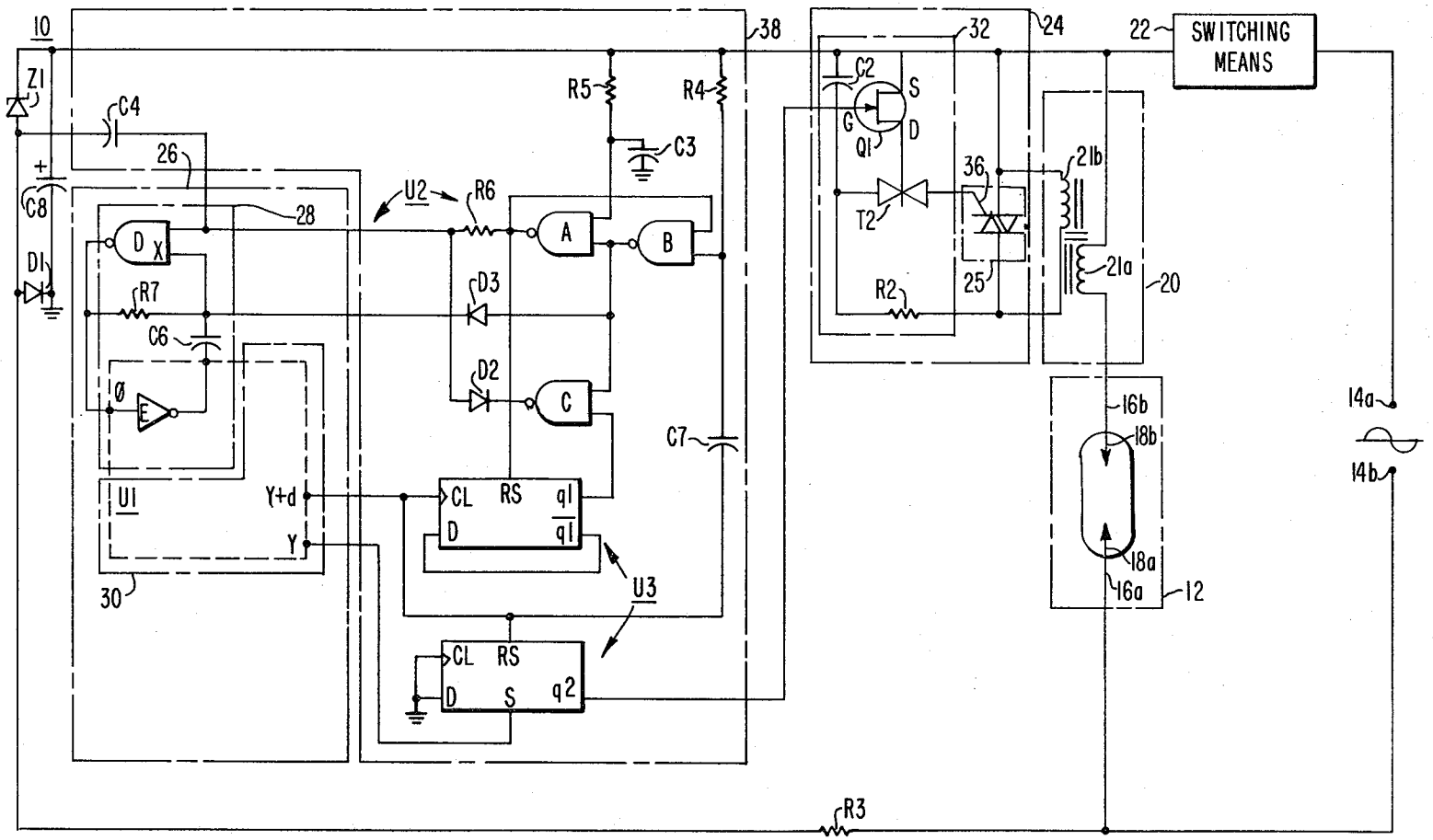

An alternative embodiment of the invention is shown in FIG. 4 wherein the illumination system 10 as shown in FIG. 4 utilizes a variable inductance ballast apparatus for the lamp ballasting means 20. For further detail of the apparatus, reference may be had to the aforesaid copending application, Ser. No. 920,291. The ballasting means 20 in this embodiment includes a main winding **21*a* which is in series with the lamp 12 and a second or control winding 21*b* having the gate-controlled switch 25 connected across same. The ballast 20 is so designed that when control winding 21*b* is in an open state, i.e. when switch 25 is OFF, it causes the ballast 20 to have the higher of two predetermined inductance values. This condition exists during the second or dimmed mode of operation. When the control winding 21*b* is energized by having switch 25 ON, the ballast 20** assumes the lower of the two inductance values. This lower inductance value is used for the first or bright mode which provides full power operation.

The state of the switch 25 is determined by the switching means 24 which either turns switch 25 ON or OFF in response to the input signal from output terminal q2 of U3. A high or logic "1" at q2 turns Q1 ON thereby inhibiting the turn-on of trigger diode T2. Switch 25 is thus OFF and ballast 20 is in the dimmed mode. When q2 goes low, Q1 is OFF thereby permitting the trigger circuit formed by C3, R2 and T2 to turn switch 25 one each half cycle of the power line thereby causing ballast 20 to assume the low inductance for the full power or bright mode.

Summarizing the operation of the present energy-conserving system 10, the lamp means are initially operated at full brightness for a predetermined initial period of time such as 4.55 hours when a high degree of illumination is desired. This is accomplished by a timing means which maintains the lamp ballast in the first operating mode which passes full or nominal power to the lamp means to cause it to operate with rated power output. Thereafter, the timing means operates to switch the lamp ballast means to the second operating mode which decreases by a predetermined amount the power which is passed to the lamp means to cause it to operate with less than nominal power. After a second period has elapsed, such as 4.8 hours, if the lamp means are still operating the lamp ballast is again switched to the first operating mode which again causes the lamp to operate with nominal power input. This takes into account the seasonal or diurnal variations which are present to provide full light output for the early morning drivers who must proceed to work in the dark, such as in the winter months. The foregoing specific examples for operating the lamp means under conditions of full brightness, then under conditions of reduced brightness, then again under conditions of full brightness are given only by way of example and can be varied. Whatever the time periods established, the present system will automatically take into account the diurnal seasonal variations which are present in order to provide the optimum of lighting when it is most needed, while simultaneously effecting an energy savings.

I claim:

1. An energy-conserving solid-state-controlled illumination system which operates lamp means at about a predetermined rated power consumption with a relatively high light output for a predetermined initial period of time during the initial night when a high degree of illumination is most needed and then operates said lamp means for a later period of the night at a reduced power which is a predetermined amount less than rated power consumption for a second predetermined period of time when a lower degree of illumination can be tolerated, and thereafter, if said lamp means is still energized according to the seasonal variations, operates said lamp means at said relatively high light output for the remainder of the night to accommodate early morning traffic, said system comprising:

a. input terminal means adapted to be connected to a source of electrical energy, and output terminal means adapted to be connected to the input terminals of said lamp means;

b. lamp ballasting means in circuit with said lamp means, said lamp ballasting means having a first operating mode in which the average power passed to said lamp means causes same to operate at about rated power consumption, and said lamp ballasting means having a second operating mode in which the average power passed to said lamp means is a predetermined amount less than the rated power consumption for said lamp means;

c. main switching means having an open state and a closed state, said switching means connected in circuit with said input terminal means and said lamp ballasting means to energize said lamp means when said switching means is in said closed state and to de-energize said lamp means when in said open state;

d. controlled switching means, the controlled closing and opening of which determines whether said ballasting means is in said first operating mode or said second operating mode;

e. timing means actuated by closing of said main switching means, said timing means when actuated, operating to generate a first time-related control signal after said initial predetermined period of time has elapsed, thereafter, said timing means continuing to operate to count down toward said second predetermined period of time, and if said timing means is still actuated by said main switching means remaining closed after said second predetermined period of time has elapsed, said timing means operating to generate a second time-related control signal, said first time-related control signal from said timing means is applied to said controlled switching means to switch said ballasting means from said first operating mode to said second operating mode, in the case said main switching means is still closed after said second predetermined period of time has elapsed, said second time-related control signal from said timing means is applied to said controlled switching means to switch said ballasting means from said second operating mode back to said first operating mode, said system continuing operation until said main switching means is opened, and said system is thereafter quiescent until said main switching means is again closed.

2. The illumination system of claim 1, wherein said timing means comprises oscillator means for generating time pulses after closing said main switching means, digital counter means for counting a first predetermined number of pulses generated by said oscillator means corresponding to said predetermined initial period of time and initiating said first time-related control signal after said first predetermined number of pulses are counted and for counting toward a second predetermined number of pulses generated by said oscillator means corresponding to said second predetermined period of time, and initiating said second time-related control signal after said second predetermined number of pulses are counted if said timing means is still energized.

3. The illumination system of claim 2, wherein said controlled switching means comprises a solid-state gate-controlled switching means.

4. The illumination system of claim 3, wherein said controlled switching means further comprises gate control means responsive to said first and second time-related control signals generated by said timing means and having an output connected to the gate of said gate-controlled switching means to control the mode of said ballasting means, and after said main switching means is switched to said closed state and when said digital counter means counts said first predetermined number of pulses from said oscillator means, said digital counter means initiates said first time-related control signal, said gate control means responding to said first time-related control signal to place said ballasting means in said second operating mode, and in the case said main switching means is still closed after said predetermined initial period of time has elapsed, said digital counter means counts said second predetermined number of pulses from said oscillator means and said digital counter means initiates said second time-related control signal, said gate control means responding to said second time-related control signal to return said ballasting means to said first operating mode until said system is de-energized by said main switching means, and said system is thereafter quiescent until said main switching means is again switched to said closed state to initiate counting of said timed pulses by said digital counter means.

5. The illumination system of claim 2, wherein said digital counter means has a reset state corresponding to a number at which said count begins, said generated timed pulses of said oscillator means having a high frequency mode for resetting said digital counter means, and a low frequency mode for causing said digital counter means to initiate said first and second time-related control signals after said first and second predetermined number of timed pulses respectively have been counted.

6. The illumination system of claim 5, wherein said system further comprises control means for initially upon energization of said ballasting means starting said high frequency mode of said oscillator means until said digital counter is reset and then stopping said high frequency mode and starting said low frequency mode of said oscillator means and causing said ballasting means to operate in said first operating mode until said first time-related control signal is generated by said digital counter means and then placing said ballasting means in said second operating mode, and in the case said main switching means is still closed after said second predetermined period of time has elapsed, upon said second time-related control signal being generated by said digital counter means, causing said ballasting means to return to said first operating mode until said system is deenergized by said main switching means.

* * * * *